United States Patent [19]

Impastato

[11] 4,143,461

[45] Mar. 13, 1979

[54] DART DEPTH GAUGE

[76] Inventor: Leona R. Impastato, 27 Gray Rock Ln., Chappaqua, N.Y. 10514

[21] Appl. No.: 786,398

[22] Filed: Apr. 11, 1977

Related U.S. Application Data

[63] Continuation-in-part of Ser. No. 690,095, May 26, 1976, abandoned.

[51] Int. Cl.[2] ..... A41H 1/00

[52] U.S. Cl. ..... 33/16; 33/148 E

[58] Field of Search ..... 33/16, 17 R, 148 E

[56] References Cited

U.S. PATENT DOCUMENTS

| | | | |
|---|---|---|---|
| 735,738 | 8/1903 | Pollett | 33/16 |
| 2,435,606 | 2/1948 | Sadowsky | 33/148 |

*Primary Examiner*—Richard E. Aegerter

*Assistant Examiner*—Willis Little

*Attorney, Agent, or Firm*—Robert E. Burns; Emmanuel J. Lobato; Bruce L. Adams

[57] ABSTRACT

A dart depth gauge comprises two flat members pivotally connected with one another. The two members have index points which are spaced from the pivot and are movable toward and away from one another by relative pivotal movement of the members. One of the members has along one edge a scale which is calibrated in terms of pattern sizes. The other member has thereon a series of curves, each of which is identified by a breast cup size. The curves are laid out so that when the members are pivoted relative to one another to bring the calibration of a selected pattern size into coincidence with a selected cup size curve, the distance between the index points is the correct depth of dart for the selected pattern size and selected cup size.

6 Claims, 7 Drawing Figures

FIG. 3
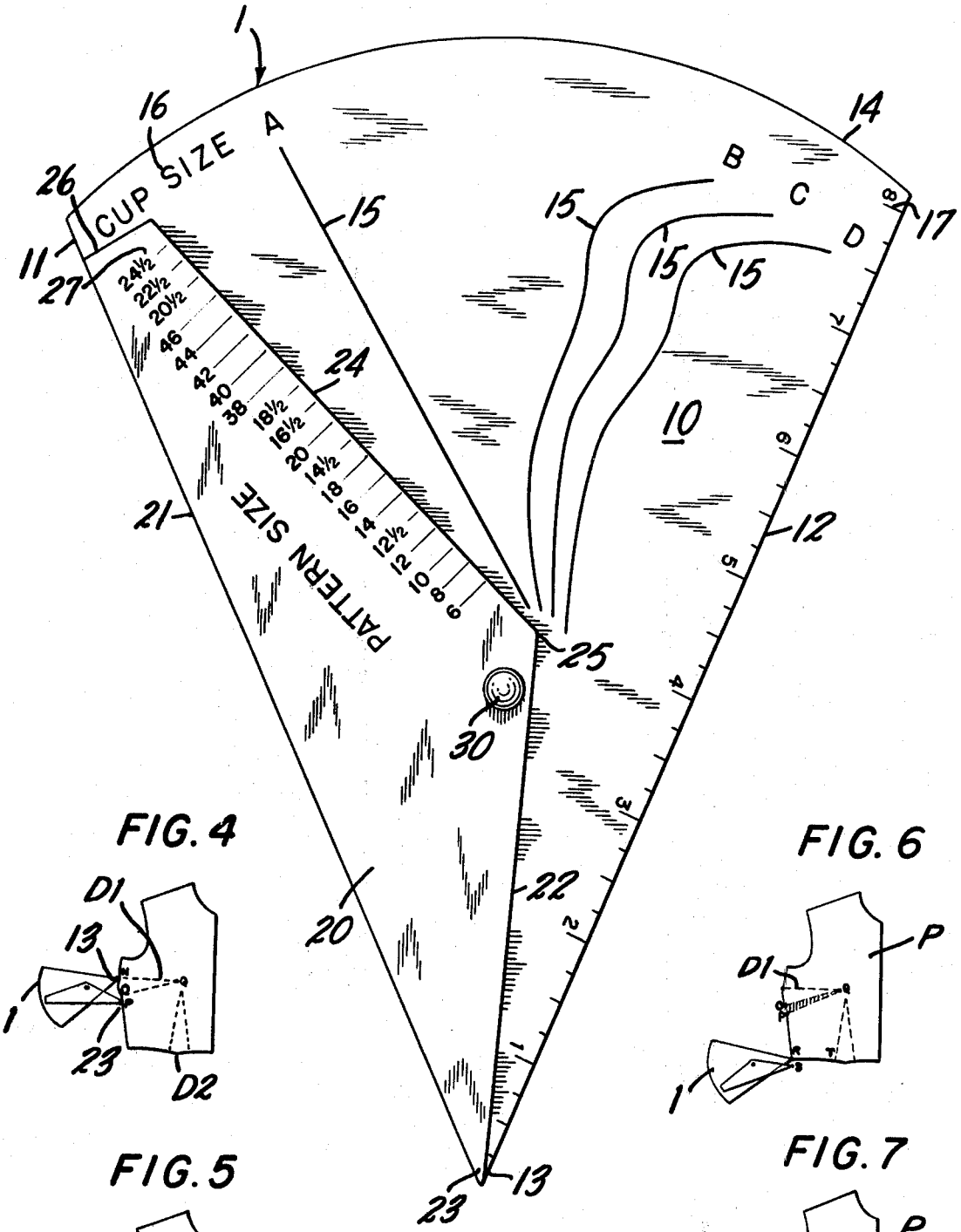
FIG. 4
FIG. 5
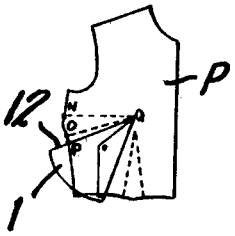
FIG. 6
FIG. 7
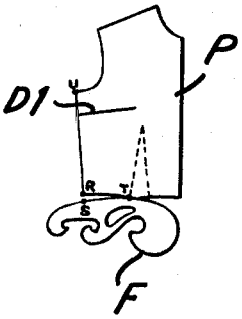

DART DEPTH GAUGE

RELATED APPLICATION

This application is a continuation-in-part of application Ser. No. 690,095 filed May 26, 1976, now abandoned.

FIELD OF INVENTION

The present invention relates to an instrument for use in dressmaking and particularly to a gauge for determining the proper depth of darts which are taken in the front of a dress, shirt or blouse to provide the fullness required for conforming to the bosom of the intended wearer.

BACKGROUND OF INVENTION

In making a dress, shirt or blouse —hereinafter referred to generically as a dress—, it is customary to take darts in the material forming the front portion in order to provide the fullness and shape required to accommodate the bosom of the wearer. These darts customarily extend in from the sides of the material which is to form the front of the garment and are located a short distance below the armholes. The location and depth of the dart are customarily shown on the dress pattern. However, if the dart is made in accordance with the pattern the garment may or may not fit the intended wearer.

Brassieres are made in different cup sizes to fit different figures. The cup sizes are designated A, B, C and D, A being the smallest cup size and D the largest. Dress patterns on the other hand come in different sizes according to the stature of the wearer but do not come in different cup sizes. Usually, patterns are designed to fit a woman having a medium or "B" cup size. Hence, if the dress is cut according to the pattern, it will be too full for a woman having an "A" cup size and not full enough for a woman having a "C" or "D" cup size. It is hence necessary for a dressmaker to attempt to adjust the depth of the darts according to the cup size of the intended wearer. However, this has heretofore been done only by guess and hence the results have dependent on the experience and skill of the dressmaker and on chance.

SUMMARY OF INVENTION

It is an object of the present invention to provide an instrument for use in dressmaking to determine accurately and scientifically according to pattern size and cup size, the correct depth of darts to be taken in the material forming the front of the garment to provide the fullness required to fit properly the figure of the intended wearer. The instrument in accordance with the invention comprises two flat superposed members which are pivotally connected with one another. The two members have index points which are spaced from the pivot and are hence movable toward and away from one another by the relative pivotal movement of the members. One of the members has along one edge a scale which is calibrated in terms of pattern sizes. The other member has on a face thereof a series of curves, each of which is identified by a breast cup size. The curves are laid out so that when the members are pivoted relative to one another to bring the calibration of a selected pattern size into coincidence with a selected cup size curve, the distance between the index points of the two members is the correct depth of dart for a selected pattern size and selected cup size. Thus, for example if the pattern is size 20 and the intended wearer has a "C" cup size, the calibration mark for pattern size 20 is brought into coincidence with the curve representing a "C" cup size. The distance between the index points of the two members is then the correct depth of darts to be taken in the material forming the front of the garment to provide proper fullness and fit.

BRIEF DESCRIPTION OF DRAWING

The nature, objects and advantages of the invention will be more fully understood from the following description of a preferred embodiment of the invention shown by way of example in the accompanying drawings in which:

FIG. 3 is a front view of a second embodiment, and FIGS. 4, 5, 6 and 7 are small scale schematic views illustrating how the instrument in accordance with the invention is used.

DESCRIPTION OF PREFERRED EMBODIMENT

Figure 1:
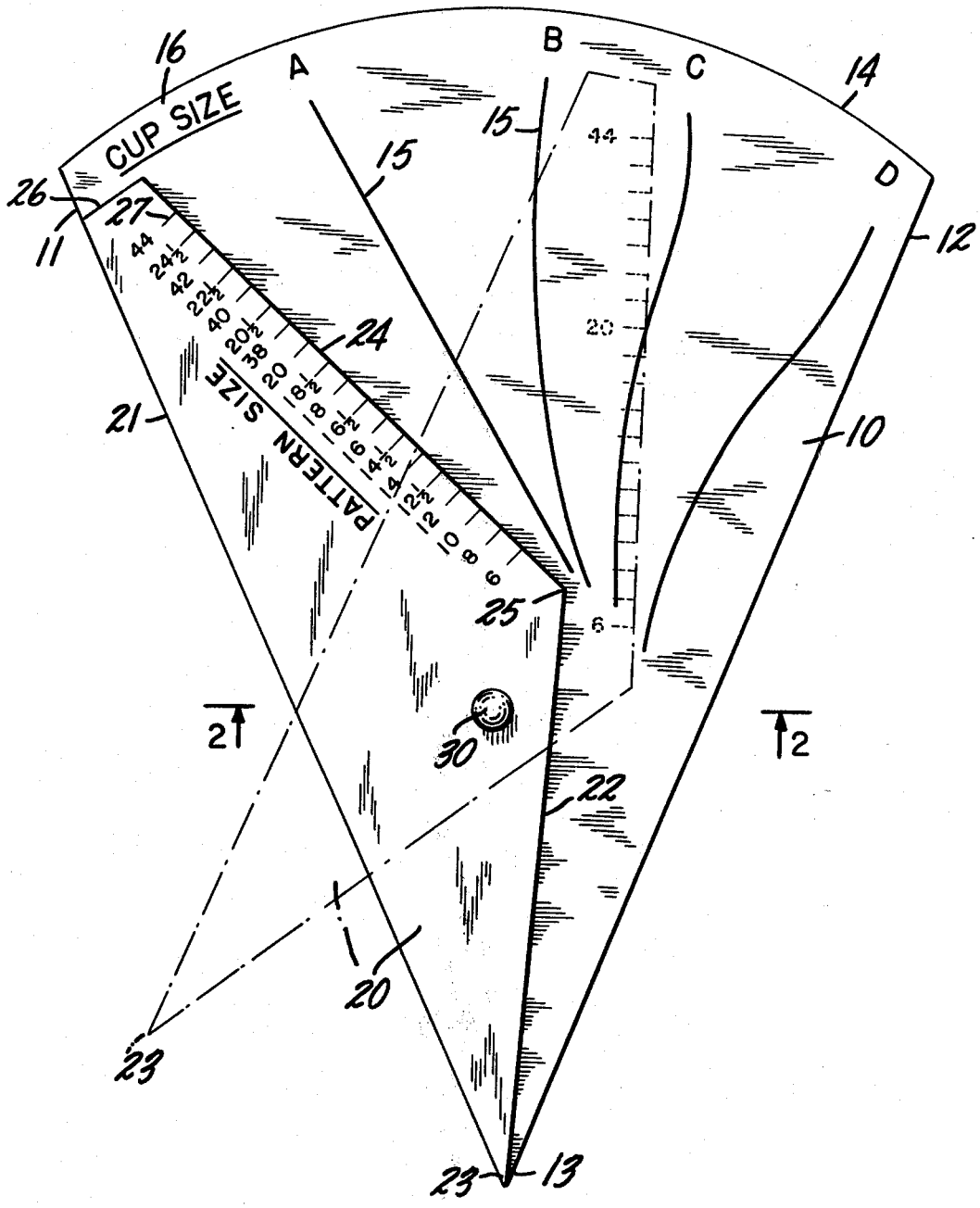
FIG. 1 is a front view of the instrument.
Figure 2:
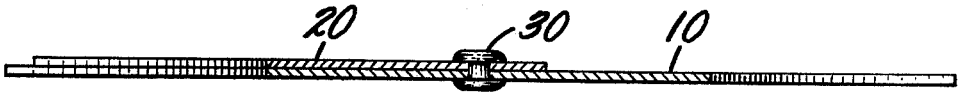
FIG. 2 is a cross section taken approximately on the line 2—2 in FIG. 1.

The instrument 1 shown by way of example in FIG. 1 and FIG. 2 comprises two flat members which for convenience of identification and without limitation are herein designated as a lower member 10 and an upper member 20. The members 10 and 20 are formed from suitable sheet material such as stiff paper, cardboard or plastic. In a preferred embodiment, at least the upper member 20 is formed of transparent sheet material so that the lower member 10 is visible through it. As illustrated in the drawings, the two members 10 and 20 are superposed on one another and are pivotally connected so that they can turn relative to one another about the pivot. The pivot is shown as comprising a double headed rivet 30 which holds the two members in frictional engagement with one another so that they can be turned manually but will be frictionally retained in whatever position they are manually set.

The lower member 10 is approximately sector shape with two straight sides 11 and 12 converging at an acute angle in a point 13 and an arcuate side 14 opposite the point. The angle between the straight sides 11 and 12 can vary somewhat but is shown as being approximately 50°. The curved side 14 is shown as an arc of a circle having its center at the pivot 30.

The upper member 20 is shown as being of triangular shape with one corner truncated. It has two straight sides 21 and 22 converging at an acute angle to form a point 23. The angle between the sides 21 and 22 of the upper member 20 is less than the angle between the sides 11 and 12 of the lower member and is shown by way of example as being about 30°. A third side 24 intersects the side 22 at an obtuse angle to form a corner 25. The angle is shown by way of example as being about 127°. A short fourth side 26 cuts off what would otherwise be a corner formed by the intersection of sides 21 and 24. The side 26 may be an arc of a circle having its center at the pivot 30 or a straight line approximating such arc.

The pivot 30 is located approximately midway between the sides 11 and 12 of the lower member 10 and at a selected distance from the point 13. As shown by way of example in the drawings, the distance between the pivot 30 and the point 13 is approximately 40% of the distance between the point 13 and the opposite side 14 as measured on a line passing through the pivot 30.

With respect to the upper member 20, the pivot 30 is located so that when the two members are in the position shown in solid lines in FIG. 1 the point 23 of the upper member coincides with the point 13 of the lower member and the side 21 of the upper member coincides with the side 11 of the lower member. As seen in FIG. 1 the corner 25 of the upper member is located above and slightly to the right of the pivot 30. The short side 26 of the upper member is spaced a short distance inwardly, i.e. toward the pivot 30 from the curved side 14 of the lower member.

As illustrated by broken lines in FIG. 1, the upper member 20 is swingable about the pivot 30 relative to the lower member 10 so as to vary the distance between the point 23 of the upper member and the point 13 of the lower member.

Along the side 24 of the upper member 20 there is provided a scale 27 which is calibrated in terms of pattern size. As shown by way of example in the drawing, the pattern sizes run from 6 to 44 with certain half sizes. The scale 27 extends along the side 24 of the upper member 20 from a point just outwardly of the corner 25 to a point somewhat inwardly of the short side 26. As shown in the drawings, the pattern sizes increase in the direction from the corner 25 to the side 26. However, if desired the scale can run in the reverse direction. Alongside the calibrated scale 27 there is provided a legend reading "PATTERN SIZE".

On the lower member 10 there is provided a series of curves 15 which extend inwardly from points near the outer side 14. The curves 15 are respectively identified by the letters A, B, C and D which are provided at the outer ends of the respective curves and represent breast cup sizes. They are identified by a legend 16 reading "CUP SIZE" which as seen in FIG. 1 appears at the left hand side of the lower member 10 just inwardly of the curved outer side 14.

The curves A, B, C and D on the lower member 14 are laid out so that when each calibration of the scale 27 on the upper member representing pattern size is brought into coincidence with a curve on the lower member representing cup size, the distance between the index points 13 and 23 is equal to the proper dart depth for that particular pattern size and cup size. Thus, for example as illustrated by broken lines in FIG. 1, when the calibration representing pattern size 20 is brought into coincidence with the curve C on the lower member, the distance between the index points 13 and 23 is equal to the proper depth of dart to be taken in the material for a cup size C when using a size 20 pattern. Representative values of dart depth for different pattern sizes and cup sizes are shown in the following tabulation:

TABLE I

| PATTERN SIZE | | | Bust | BREAST CUP SIZE | | | |
|---|---|---|---|---|---|---|---|
| Miss | Half | Woman | Size | A | B | C | D |
| 6 | | | 30 1/2 | 1 | 1 3/8 | 2 1/4 | 3 1/3 |
| 8 | | | 31 1/2 | 1 | 1 7/16 | 2 5/16 | 3 3/16 |
| 10 | | | 32 1/2 | 1 | 1 1/2 | 2 3/8 | 3 1/4 |
| 12 | | | 34 | 1 | 1 9/16 | 2 7/6 | 3 5/16 |
| | 12 1/2 | | 35 | 1 | 1 5/8 | 2 1/2 | 3 3/8 |
| 14 | | | 36 | 1 | 1 11/16 | 2 9/16 | 3 7/16 |
| | 14 1/2 | | 37 | 1 | 1 3/4 | 2 5/8 | 3 1/2 |
| 16 | | | 38 | 1 | 1 13/16 | 2 5/8 | 3 9/16 |
| | 16 1/2 | | 39 | 1 | 1 7/8 | 2 11/16 | 3 5/8 |
| 18 | | | 40 | 1 | 1 7/8 | 2 11/16 | 3 11/16 |
| | 18 1/2 | | 41 | 1 | 1 15/16 | 2 3/4 | 3 3/4 |
| 20 | | | 42 | 1 | 1 15/16 | 2 13/16 | 3 13/16 |
| | | 38 | 42 | 1 | 2 | 2 7/8 | 3 7/8 |
| | 20 1/2 | | 43 | | 2 | 2 7/8 | 3 7/8 |
| | | 40 | 44 | | 2 1/16 | 2 15/16 | 3 15/16 |

TABLE I-continued

| PATTERN SIZE | | | Bust | BREAST CUP SIZE | | | |
|---|---|---|---|---|---|---|---|
| Miss | Half | Woman | Size | A | B | C | D |
| | 22 1/2 | | 45 | | 2 1/8 | 2 15/16 | 3 15/16 |
| | | 42 | 46 | | 2 3/16 | 3 | 4 |
| | 24 1/2 | | 47 | | 2 1/4 | 3 | 4 |
| | | 44 | 48 | | 2 1/4 | 3 | 4 |

The bust sizes and the values of dart depth given in columns A, B, C and D are in inches. However, it will be understood that metric measures can be used if desired. Moreover, while the values of dart depth given in the table are based on an extensive study of the proper dart depth for each pattern size and cup size, it will be understood that these can be modified if desired. The length of the dart in each instance can be in proportion to the dart indications on the pattern and accordingly may vary from about 6 inches to about 10 inches.

A second embodiment of the invention is shown in FIG. 3. As the embodiment of FIG. 3 is basically the same as that of FIGS. 1 and 2 the parts are designated by the same reference numerals and the description need not be repeated. However, in FIG. 3 the scale 27 which extends along the edge 24 of the upper member 20 is somewhat different from that shown in FIG. 1. Moreover, the curves B, C, and D are different in FIG. 3. The instrument shown in FIG. 1 is intended for dresses in which the shaping of the bosom portion is achieved by two darts, one at each side. The embodiment shown in FIG. 3 is intended primarily for use with patterns in which the bosom part is separate from the skirt part so that darts can be taken not only at the sides but also at the waistline. Hence, the depth of the darts taken as the sides are different from the depth provided by the illustration in FIGS. 1 and 2. Representative values of dart depth for different pattern sizes and cup sizes with the instrument illustrated in FIG. 3 are shown in the following tabulation.

TABLE II

| MISS SIZES | B CUP | C CUP | D CUP |
|---|---|---|---|
| 6 | 1 5/8 | 2 5/16 | 2 13/16 |
| 8 | 1 3/4 | 2 7/16 | 2 15/16 |
| 10 | 1 7/8 | 2 9/16 | 3 |
| 12 | 2 | 2 5/8 | 3 1/16 |
| 14 | 2 3/16 | 2 13/16 | 3 3/16 |
| 16 | 2 5/16 | 2 7/8 | 3 1/4 |
| 18 | 2 1/2 | 2 15/16 | 3 1/4 |
| 20 | 2 3/4 | 3 1/16 | 3 1/2 |
| HALF SIZES | | | |
| 12 1/2 | 2 3/16 | 2 11/16 | 3 1/16 |
| 14 1/2 | 2 9/16 | 2 15/16 | 3 5/16 |
| 16 1/2 | 2 13/16 | 3 3/16 | 3 9/16 |
| 18 1/2 | 2 15/16 | 3 5/16 | 3 3/4 |
| 20 1/2 | 3 1/4 | 3 5/8 | 4 |
| 22 1/2 | 3 1/2 | 3 7/8 | 4 1/4 |
| 24 1/2 | 3 3/4 | 4 1/8 | 4 1/2 |
| WOMEN SIZES | | | |
| 38 | 3 | 3 2/8 | 3 3/4 |
| 40 | 3 1/16 | 3 7/16 | 3 13/16 |
| 42 | 3 1/16 | 3 7/16 | 3 13/16 |
| 44 | 3 1/16 | 3 7/16 | 3 13/16 |
| 46 | 3 1/16 | 3 7/16 | 3 13/16 |

The embodiment of FIG. 3 further differs from that shown in FIG. 1 in that a linear scale 17 is provided along the straight edge 12 of the lower member 10. The scale starts at the point 13. While an inch scale is shown the scale may if desired be in centimeters.

The manner in which the instrument is used is illustrated schematically in FIGS. 4 to 7. In these figures there is shown a pattern P which is a pattern for the left half of the bosom portion of a dress or other garment. The pattern is shown as providing two darts D1 and D2. The darts shown on patterns are customarily darts appropriate for a B size breast cup. Thus the depth of the side dart D1, shown in dotted lines in FIG. 4 is the distance NO. Assuming that the intended wearer has a C cup size the upper member 20 of the instrument 1 is moved about the pivot 30 so that the pattern size coincides with curve C representing a C cup size. The distance between the points 13 and 23 of the instrument is the proper depth for a C cup size. After being thus adjusted the instrument is applied to the side edge of the pattern P as illustrated in FIG. 4 with the point 13 of the instrument coinciding with the point N on the pattern. A mark is then made on the pattern at the point of engagement of point 3 of the instrument, the point on the pattern being designated P. The distance NP then represents the proper depth of dart for a C cup size.

The instrument 1 is then laid on the pattern P with the straight edge 12 of the instrument extending between the point P and the point Q which represents the point of the dart. A line PQ is then drawn along the edge 12 of the instrument 1. A dart of the proper size is then defined by the triangle QNPQ. The length of the dart is measured by the scale 17 which extends along the edge 12 of the instrument and may be adjusted as desired.

By reason of the dart depth NP being greater than the original dart NO of the pattern the side edge of the material forming the bosom part of the garment will be shortened by the distance OP when the dart is stiched in the fabric. To compensate for this difference the instrument 1 is set so that the distance between the points 13 and 23 is equal to the distance OP. The instrument is then used as illustrated in FIG. 6 to add a corresponding length RS to the side edge of the pattern. A french curve is then used, as illustrated in FIG. 7, to draw a line ST which represents an appropriate lengthening of the side of the pattern. In FIG. 7 the dart D1 is shown pinned closed.

It will thus be seen that the instrument in accordance with the present invention eliminates the guesswork which was previously necessary in making breast darts and makes it possible to determine the proper dart depth for each pattern size and each cup size. The instrument is sufficiently simple that it can be used by the average seamstress or housewife with only minimal directions. The dart depth gauge in accordance with the invention thus represents an important advance in the dressmaking art.

While preferred embodiments of the invention have been illustrated by way of example in the drawings and are herein particularly described it will be understood that the instrument may be modified as to size and shape without departing from the spirit and scope of the invention and that the invention is hence in no way limited to the illustrated embodiments.

What is claimed is:

1. In the process of dressmaking, the method of shaping the bosom-covering portion of a dress properly to fit the intended wearer, which method comprises the steps of:

providing a pattern for a selected garment having a bosom portion, providing a dart depth gauge comprising first and second superposed flat members pivotally connected with one another, said members having index points which are equally spaced from said pivot and are movable toward and away from one another by relative pivotal movement of said members, said first member having a straight outer edge, said second member having an inner edge extending along a side thereof outwardly of said pivot from said index point and overlying said first member and a scale extending along said inner edge with calibrations in terms of pattern size, and said first member having on a face thereof a plurality of curves each of which is identified as breast cup size, said curves being related to the pattern size calibrations on said second member in the manner that when said members are pivoted to bring a selected pattern size calibration into coincidence with a selected breast cup size curve the distance between said index points of the two members is the correct depth of dart for the selected pattern size and the selected breast cup size, positioning said second member relative to said first member to bring the calibration on said second member corresponding to the pattern size into coincidence with the curve on said first member corresponding to the breast cup size of the intended wearer of the garment, applying the index points of said members as thus positioned to a side edge of the pattern for the bosom portion of the garment and marking on said pattern the location of said index points, the spacing between said index points determining the correct depth of dart for the pattern size and breast cup size of the intended wearer, drawing on the pattern lines defining a dart of the depth determined by the spacing between said index points, transferring to material for the bosom portion of said garment the outline of said pattern and said dart-defining lines, and forming in said material a dart of the depth determined by the spacing of said index points.

2. A process according to claim 1, in which said first member of said dart depth gauge is sector shaped defined by two straight side edges which converge at an acute angle to define said index point of said first member and an arcuate third side edge, and in which after marking on said pattern the location of said index points said dart depth gauge is laid on said pattern with one of said straight side edges of said dart depth gauge in position to define a dart whereupon a line defining said dart is drawn along said straight side edge.

3. A process according to claim 2, in which a linear scale is provided along one of said straight side edges of said first member of said dart depth gauge, and in which said dart depth gauge is laid on said pattern with said scale extending inwardly from the side edge of said pattern in which a dart is to be formed whereupon the length of said dart is laid out with said scale.

4. A dart depth gauge comprising:

a first flat member which is sector shaped defined solely by first and second equal straight side edges converging at an acute angle to define a first index point and a third side edge which is arcuate and is opposite said point, a second flat member which is superposed on said first member and is trapezium shaped defined solely by first and second approximately equal straight side edges meeting at an obtuse angle, a third straight side edge opposite said obtuse angle and meeting said first side edge in an acute angle to define a second index point which is sharper than said index point of said first member, and a fourth short side edge approximately normal to said third side edge connecting said third and second side edges, means pivotally connecting said first and second members with a pivot axis which is near said obtuse angle of said second member and the underlying point of said first member when said second member is placed on said first member with said index points coincident and said third side edge of said second member coincident with the first side edge of said first member, means defining a scale extending along said second side edge of said second member and comprising spaced scale markings extending in from said second side edge of said second member with calibrations in terms of pattern size, means defining on said first member in the area between said pivot axis and said arcuate third side edge a family of curves each of which is identified with a breast cup size, said curves being related to the pattern size calibrations of said scale defining means on said second member in the manner that when said members are pivoted to bring a selected pattern size calibration into coincidence with a selected breast cup size curve, the distance between said index points of the two members is the correct depth of dart for said selected pattern size and selected breast cup size; and means defining indicia disposed adjacent repsective ones of said curves and adjacent said arcuate third edge of said first member identifying the respective curves by breast cup size, the curve for each of said breast cup sizes being the locus of points located on said first member by positioning said first and second index points at a predetermined distance from one another equal to the correct depth of dart for said breast cup size and a selected pattern size and thereupon locating a point on said first member at the intersection of the calibrated scale marking of said scale defining means corresponding to said selected pattern size with said second edge of said second member and repeating such point location for other pattern sizes.

5. A dart depth gauge according to claim 4, further comprising means defining a linear measuring scale extending along said second side edge of said first member.

6. A dart depth gauge according to claim 4, in which said first and second side edges of said first member define an angle of approximately 50° and said first and third side edges of said second member define an angle of approximately 30°.

* * * * *